US005529180A

United States Patent [19]

Paolucci et al.

[11] Patent Number: 5,529,180

[45] Date of Patent: Jun. 25, 1996

[54] SEMIRIGID PACKET FOR ELONGATED ELEMENTS, PARTICULARLY CIGARETTES

[75] Inventors: Enrico Paolucci, Budrio; Romano Chiesi, Bologna, both of Italy

[73] Assignee: G. D Societa' per Azioni, Bologna, Italy

[21] Appl. No.: 270,923

[22] Filed: Jul. 5, 1994

[30] Foreign Application Priority Data

Jul. 8, 1993 [IT] Italy ..... BO93A0316

[51] Int. Cl.[6] ..... B65D 85/10

[52] U.S. Cl. ..... 206/273; 206/264; 206/268

[58] Field of Search ..... 206/264, 265, 206/268, 271, 273; 229/87.12, 160.1

[56] References Cited

U.S. PATENT DOCUMENTS

| | | | |
|---|---|---|---|
| 2,341,415 | 2/1944 | Adams | 229/87 |
| 2,480,501 | 8/1949 | Moore | 206/273 |
| 2,767,832 | 10/1956 | Silberman | 206/268 |
| 2,931,553 | 4/1960 | Tamarin | 229/17 |
| 3,090,541 | 5/1963 | Janda | 206/268 |
| 3,524,583 | 8/1970 | Gregory | 206/273 |
| 3,897,900 | 8/1975 | Gorski et al. | 206/273 |
| 4,119,196 | 10/1978 | Flaherty | 206/271 |
| 4,753,383 | 6/1988 | Focke et al. | 206/271 |
| 4,920,728 | 5/1990 | Shibuya | 53/410 |

FOREIGN PATENT DOCUMENTS

| | | |
|---|---|---|
| 0204933 | 4/1986 | European Pat. Off. . |
| 0507112 | 3/1992 | European Pat. Off. . |
| 2819147 | 5/1978 | Germany . |

*Primary Examiner*—David T. Fidei
*Attorney, Agent, or Firm*—Ladas & Parry

[57] ABSTRACT

A semirigid cigarette packet defined by a closed soft inner wrapping normally made of foil, and by a cup-shaped outer container formed from a semirigid blank and having an open end for enabling access to a corresponding closed end of the inner wrapping: the outer container presenting longitudinal edges with a flat or rounded bevel.

14 Claims, 2 Drawing Sheets

SEMIRIGID PACKET FOR ELONGATED ELEMENTS, PARTICULARLY CIGARETTES

BACKGROUND OF THE INVENTION

The present invention relates to a semirigid packet for elongated elements, particularly cigarettes.

In the following description, reference is made purely by way of example to a semirigid cigarette packet.

The cigarettes coming off a production machine are normally formed into groups, each constituting the content of a "soft" packet, to which the following description substantially refers, or a rigid packet.

Known soft packets normally comprise a closed inner wrapping, normally of foil and substantially in the form of a rectangular parallelepipedon; and a tubular lateral wrapping normally made of paper or similar, and which either covers only the longitudinal lateral walls of the inner wrapping, or is longer than the lateral walls and presents a projecting portion which is folded to form a soft cup-shaped outer container. The soft outer container is in the form of a rectangular parallelepipedon open at one end to enable access to a corresponding closed end of the inner wrapping.

Known packets of the above type present several drawbacks, mainly due to the use of relatively soft wrapping materials which in no way provide for protecting the cigarettes against external stress.

As yet, the above drawbacks have been solved by rigid hinged-lid packets which, however, are relatively expensive to produce.

SUMMARY OF THE INVENTION

It is an object of the present invention to provide a perfected packet which is relatively cheap to produce, of a cost comparable to that of known soft packets, and which, like rigid packets, provides for protecting the content against external stress.

According to the present invention, there is provided a semirigid packet for elongated elements, particularly cigarettes, comprising a closed soft inner wrapping, and a cup-shaped outer container with an open end enabling access to a corresponding closed end of the inner wrapping; characterized in that the outer container is formed from a semirigid blank with preformed bend lines.

The outer container and the inner wrapping of the above packet are preferably made integral with each other by a strip extending across said open end and integral, at its opposite ends, with the outer container.

The above packet also preferably comprises a closed outer wrapping preferably made of transparent material and enclosing both the inner wrapping and the outer container.

In general, the above packet is substantially in the form of a parallelepipedon with a rectangular base, and therefore presents sharp outer edges which may result in relatively severe damage to clothing.

To overcome the above drawback and also better seat the cigarettes transversely inside the outer container, in a preferred embodiment of the present invention, the outer container of the packet as described above is in the form of a parallelepipedon with beveled longitudinal edges.

More specifically, the beveled edges are either flat beveled edges defined by an oblique face, or are rounded beveled edges.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
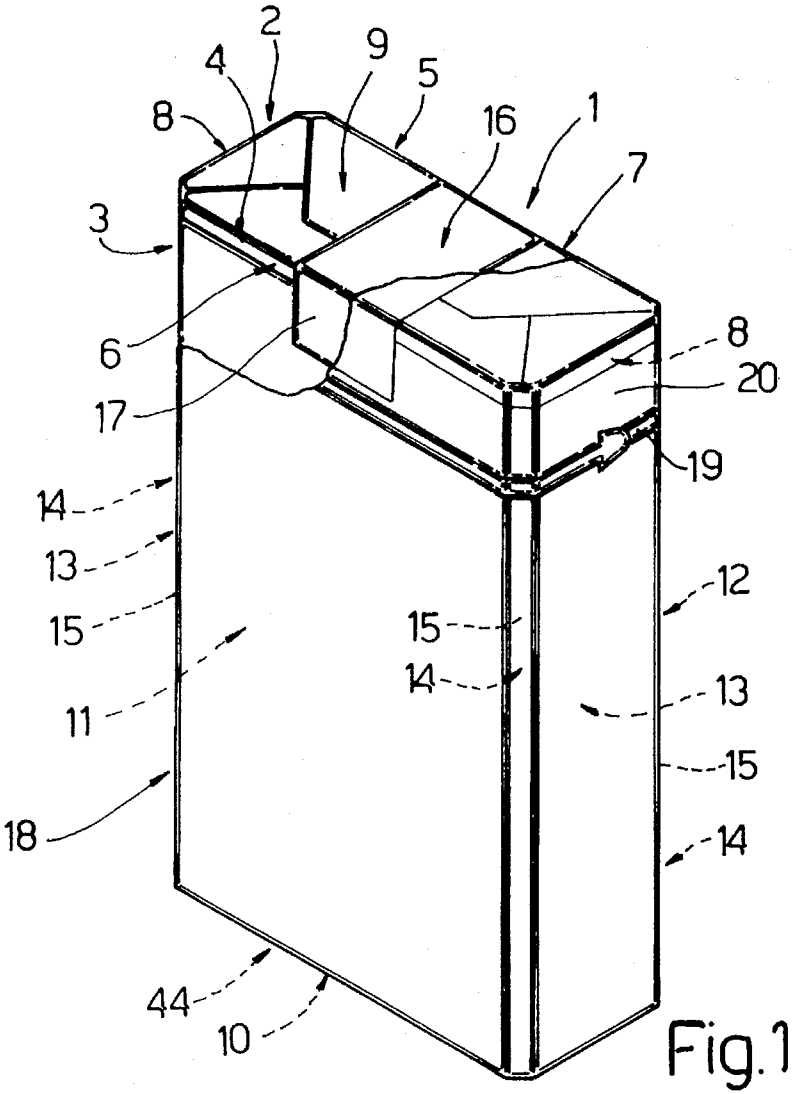
FIG. 1 shows a view in perspective of a first preferred embodiment of the packet according to the present invention.

Number 1 in FIG. 1 indicates a semirigid packet for elongated elements (not shown), in particular cigarettes.

Packet 1 comprises a closed soft inner wrapping 2 in the form of a parallelepipedon with a substantially rectangular base; and a cup-shaped outer container 3 with an open end 4 enabling access to a corresponding closed end 5 of inner wrapping 2. More specifically, inner wrapping 2 is made of foil or similar, folded to define a front lateral wall 6, a rear lateral wall 7, two lateral walls 8, and two end walls 9, only one of which, at end 5, is visible. Container 3 is defined, at the opposite end to open end 4, by a substantially rectangular bottom surface 10, and presents a lateral surface defined by large rectangular front and rear surfaces 11 and 12 identical and parallel to each other, and two rectangular lateral surfaces 13 parallel to each other and perpendicular to surfaces 11 and 12.

As shown in FIG. 1, each surface 11, 12 is connected to each adjacent surface 13 along a flat beveled longitudinal edge 14 defined by a respective oblique rectangular face 15 forming an angle of preferably 45° with the adjacent lateral surface 13.

Container 3 and wrapping 2 are made integral with each other by means of a strip 16 gummed on one face, extending across open end 4 of container 3, and having opposite end portions 17 (only one shown) connected integral with surfaces 11 and 12.

Packet 1 also comprises a closed outer wrapping 18 similar to wrapping 2 but normally made of transparent material, and enclosing both wrapping 2 and container 3. Wrapping 18 presents a tear-off strip 19 located substantially at open end 4 of container 3, for tearing off an end portion 20 of wrapping 18 and enabling access to closed end 5 of wrapping 2.

Figure 2:
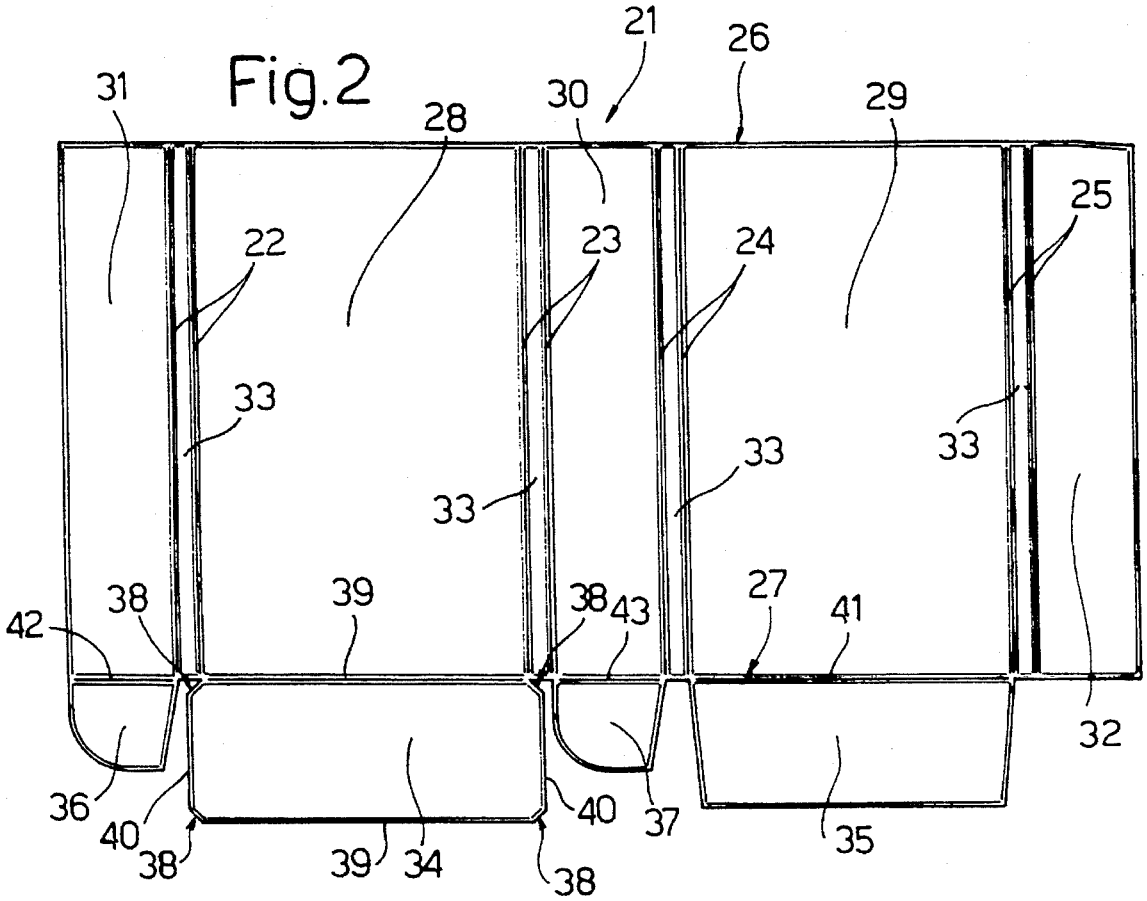
FIG. 2 shows a spread-out blank of a portion of the FIG. 1 packet.

As shown in FIG. 2, container 3 is formed, by way of example, from a flat semirigid blank 21 substantially in the form of an elongated rectangle and having a number of pairs of longitudinal bend lines 22, 23, 24, 25 extending between a straight transverse end edge 26 defining the edge of open end 4 of container 3, and a transverse bend line 27 parallel to edge 26. Pairs of bend lines 22, 23, 24, 25 define two large rectangular panels 28 and 29; a small rectangular panel 30 between panels 28 and 29; and two rectangular outer panels 31 and 32 respectively adjacent to panels 28 and 29, and of a width approximately equal to but no more than the width of panel 30. The lines in each pair of bend lines 22, 23, 24, 25 define a respective panel consisting of a rectangular elongated longitudinal strip 33 roughly equal in width to the radius of the cigarettes (not shown) inside wrapping 2.

Line 27 defines four tabs 34, 35, 36, 37 aligned respectively with panels 28, 29, 31, 30. Tab 34 is substantially rectangular, and presents four straight 45° bevels 38 equal in length to the width of strips 33. Bevels 38 define, on tab 34, two long sides 39 equal in length to the width of panels 28, 29, and one of which extends along line 27; and two short sides 40 equal in length to the width of panel 30.

Tab 35 is substantially trapezoidal with its longer side 41 along line 27, and presents a length equal to the width of panel 29, and a width approximately equal to but no more than the width of tab 34. Tabs 36 and 37 are substantially in the form of a laterally rounded trapezium with their respective longer sides 42, 43 along line 27, and are equal in length to the width of panels 31 and 30.

Container 3 is formed by squarely bending panels 28 and 29 in relation to panel 30; squarely bending panels 31 and 32 in relation to panels 28 and 29 to position and gum panel 31 onto the outer surface of panel 32; squarely bending tabs 36 and 37 in relation to panels 31 and 30 and towards each other; squarely bending tab 35 in relation to panel 29 and gumming it onto the outer surface of tabs 36 and 37; and, finally, by squarely bending tab 34 in relation to panel 28 and gumming it onto the outer surface of tab 35 to define, together with tabs 35, 36 and 37, a bottom wall 44 defined externally by surface 10 and integral with panels 28, 29, 30, 31, 32, but not with strips 33.

As such, panels 28, 29, 30 and 31 define surfaces 11, 12 and 13 of container 3; and, when blank 21 is folded onto wrapping 2, the longitudinal edges of wrapping 2 are deformed slightly on contacting the inner surface of strips 33, and adhere to the outer surface of the group (not shown) of cigarettes (not shown) inside wrapping 2, thus preventing any transverse movement of the cigarettes.

Figure 3:
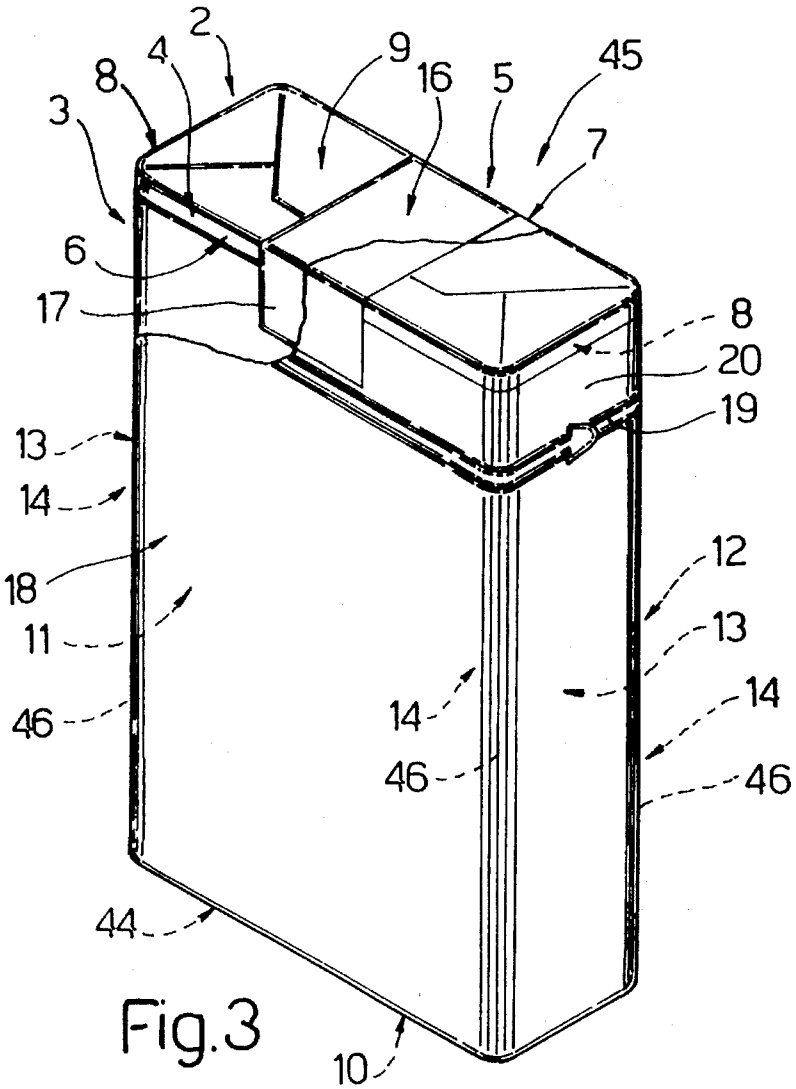
FIG. 3 shows a view in perspective of a second preferred embodiment of the packet according to the present invention.

The variation in FIG. 3 relates to a packet 45 substantially similar to packet 1, and the component parts of which are indicated, wherever possible, using the same numbering system as for the corresponding parts of packet 1.

Figure 4:
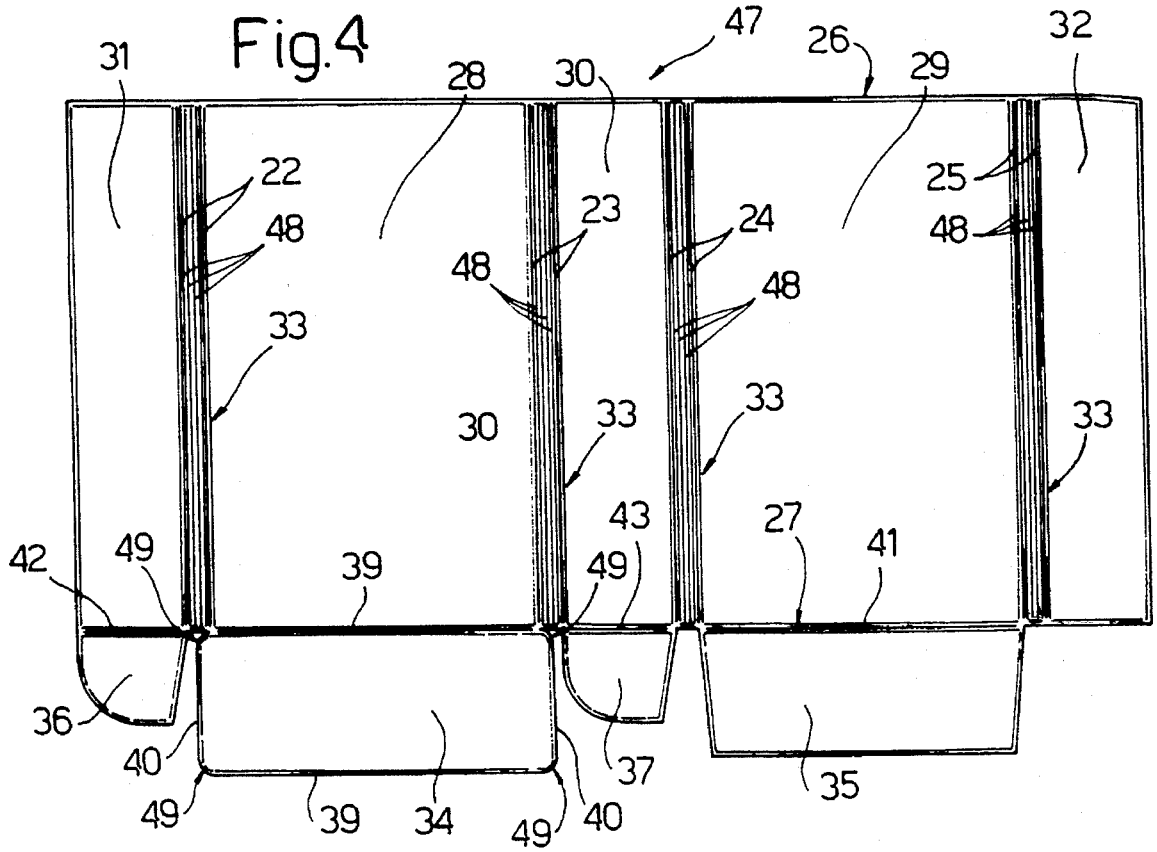
FIG. 4 shows a spread-out blank of a portion of the FIG. 3 packet.

Substantially the only difference between packets 45 and 1 is that, as opposed to being defined by flat faces 15, the beveled edges 14 of container 3 of packet 45 are each defined by a rounded, substantially cylindrical surface 46 with substantially the same diameter as the cigarettes (not shown) in wrapping 2, and tangent to the adjacent lateral surfaces of container 3. For this purpose, and as shown in FIG. 4, packet 45 is formed for example from a blank 47 substantially similar to blank 21, except that, between the lines in each pair of bend lines 22, 23, 24, 25 defining respective strips 33, a number of closely spaced parallel bend lines 48 are formed, and tab 34 presents rounded bevels 49 as opposed to flat bevels 38.

We claim:

1. A semirigid packet for elongated elements, comprising a closed soft inner wrapping, and a cup-shaped outer container which has an open end enabling access to a corresponding closed end of the inner wrapping and is formed from a semirigid blank with preformed bend lines; said semirigid blank being substantially rectangular, and being defined on a first side by a straight transverse edge defining an edge of said open end; said preformed bend lines comprising, a transverse bend line defining a second side of the semirigid blank opposite to said first side, and a number of longitudinal bend lines defining a number of side by side panels between said edge and said transverse bend line; and a number of tabs projecting beyond said transverse bend line.

2. A packet as claimed in claim 1, wherein a strip extends across said open end and is integral, at opposite ends of said strip, with the outer container to make the outer container and the inner wrapping integral with each other.

3. A packet as claimed in claim 1 further comprising a closed outer wrapping enclosing both the inner wrapping and the outer container.

4. A packet as claimed in claim 3, wherein said outer wrapping is made of transparent material.

5. A packet as claimed in claim 1, wherein said outer container is in the form of a parallelepipedon with bevelled longitudinal edges; said longitudinal bend lines defining a number of pairs of longitudinal bend lines; and the lines in each said pair of longitudinal bend lines defining a longitudinal strip in turn defining a respective said bevelled edge.

6. A packet as claimed in claim 5, wherein said bevelled edges are flat bevelled edges, each defined by a respective oblique face.

7. A packet as claimed in claim 5 wherein said bevelled edges are rounded bevelled edges defined by respective rounded, substantially cylindrical surfaces.

8. A packet as claimed in claim 5, wherein said side by side panels comprise two large panels; and three small panels, a first of which is an intermediate panel between the two large panels, and the other two of which are outer panels of a width approximately equal to but no more than the width of the intermediate panel.

9. A packet as claimed in claim 5, wherein a first of said tabs is substantially rectangular, and presents four bevelled corners equal in length to the width of said strips; said bevels defining, on said first tab, two long sides equal in length to the width of the large panels and one of which extends along said transverse bend line, and two short sides equal in length to the width of the intermediate panel.

10. A packet as claimed in claim 9, wherein each said corner presents a flat bevel.

11. A packet as claimed in claim 9, wherein each said corner presents a rounded bevel.

12. A packet as claimed in claim 11, wherein each said longitudinal strip presents a number of further longitudinal bend lines.

13. A packet as claimed in claim 2, wherein a closed outer wrapping enclosing both the inner wrapping and the outer container.

14. A packet as claimed in claim 1, wherein a first of said tabs is substantially rectangular, and presents four bevelled corners equal in length to the width of said strips; said bevels defining, on said first tab, two long sides equal in length to the width of the large panels and one of which extends along said transverse bend line, and two short sides equal in length to the width of the intermediate panel.

* * * * *